United States Patent [19]

Hetra, Jr. et al.

[11] 4,165,866

[45] Aug. 28, 1979

[54] DEVICE FOR SKIMMING FLOATING MATERIAL FROM A BODY OF LIQUID

[75] Inventors: Andrew A. Hetra, Jr., Pittsburgh; Charles W. Jacob, Crafton, both of Pa.

[73] Assignee: United States Steel Corporation, Pittsburgh, Pa.

[21] Appl. No.: 892,364

[22] Filed: Mar. 31, 1978

[51] Int. Cl.[2] ..... C22B 7/00

[52] U.S. Cl. ..... 266/228

[58] Field of Search ..... 210/525, 527; 266/120, 266/130, 166, 228, 238, 37; 91/12.5; 134/134; 198/19; 118/426

[56] References Cited

U.S. PATENT DOCUMENTS

| | | | |
|---|---|---|---|
| 1,025,027 | 4/1912 | Stobrawa | 266/228 |
| 1,916,460 | 7/1933 | Bousman | 210/527 |
| 2,424,808 | 7/1947 | Eckman | 91/12.5 |
| 2,701,546 | 2/1955 | Townsend | 118/426 |
| 2,951,491 | 9/1960 | Olson | 134/134 |
| 3,559,794 | 2/1971 | McConnell | 198/19 |
| 3,635,349 | 1/1972 | Weiss et al. | 210/527 |
| 3,756,418 | 9/1973 | Pentz et al. | 210/525 |
| 3,941,360 | 3/1976 | Blank | 266/37 |
| 4,011,164 | 3/1977 | McGivem | 210/525 |

FOREIGN PATENT DOCUMENTS

| | | | |
|---|---|---|---|
| 2416158 | 9/1975 | Fed. Rep. of Germany | 210/527 |

*Primary Examiner*—Theodore A. Granger
*Attorney, Agent, or Firm*—Walter P. Wood

[57] ABSTRACT

A device for skimming floating material from a body of liquid, particularly useful with a pipe galvanizing apparatus for skimming dross from a zinc bath. The device includes paddles pivoted to a reciprocating carriage for dragging floating material to an edge of the vessel. The paddles pivot to positions in which their faces lie parallel with the direction of carriage movement to avoid pushing material back toward the interior of the vessel during return strokes of the carriage.

7 Claims, 3 Drawing Figures

DEVICE FOR SKIMMING FLOATING MATERIAL FROM A BODY OF LIQUID

This invention relates to an improved device for skimming floating material from a body of liquid.

Although our invention is not thus limited, the device is particularly useful for skimming dross from a molten zinc bath used for galvanizing pipes. For illustrative purposes we show the device used with a well known type of pipe galvanizing apparatus which includes a kettle containing a molten zinc bath and a series of magnetic dragout rolls above the kettle for withdrawing pipes from the bath in an upwardly inclined direction. For exemplary showing of several forms of such apparatus, reference can be made to Eckman U.S. Pat. No. 2,424,808, Townsend U.S. Pat. No. 2,701,546, Olson U.S. Pat. No. 2,951,491, or McConnell et al U.S. Pat. No. 3,559,794.

A floating layer of dross forms on the zinc bath and tends to collect on the pipe as it emerges. If a pipe carries excessive dross, it must either be scrapped or the zinc coating removed and the pipe reprocessed. Heretofore th practice has been to skim or stir the bath manually to keep the dross from the emerging pipe. The operator must work at the edge of the kettle with the temperature of the zinc bath approaching 780° F. and around moving machinery which conveys pipes from the kettle and unavoidably splashes molten zinc. Large fans located near the kettle and directed at the operator keep the area at a workable temperature, but add to the noise level. Hence the operator is subject to uncomfortable and hazardous working conditions.

An object of our invention is to provide an improved skimming device which can be supported on a vessel, such as a galvanizing kettle, for continually and automatically skimming floating material from a bath contained in the vessel.

A further object is to provide a reciprocating skimming device which on its skimming stroke drags floating material toward an edge of a vessel, and on its return stroke avoids pushing the material back toward the interior of the vessel.

A more specific object is to provide an improved skimming device which includes a pivoted paddle and means for moving the paddle within a body of liquid through skimming and return strokes, and in which the faces of the paddle at the beginning of a skimming stroke lie substantially parallel with the direction of movement, but approximately halfway through the stroke reach a position transverse to the direction of movement, and in which during the return stroke the paddles first return to their parallel positions to avoid pushing material back on the surface of the liquid.

Figure 1:
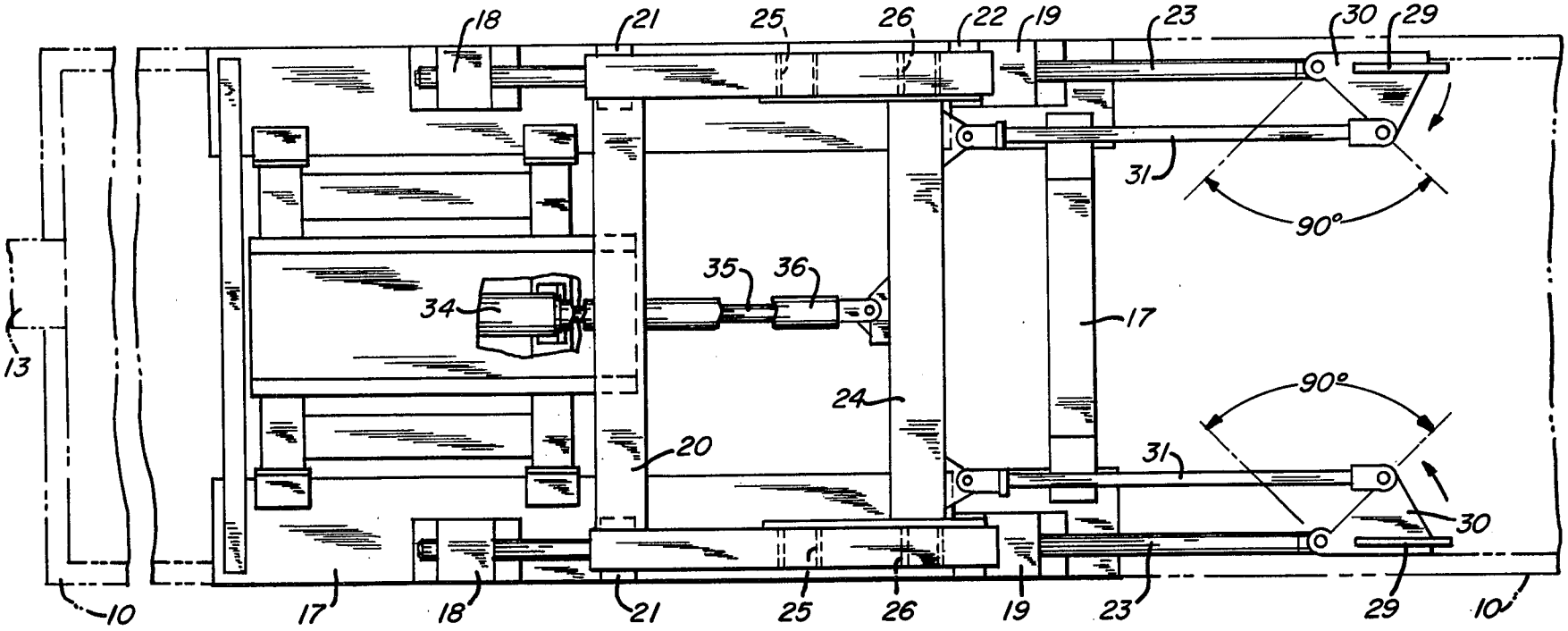
FIG. 1 is a top plan view of our skimming device installed on the kettle of a galvanizing apparatus.
Figure 2:
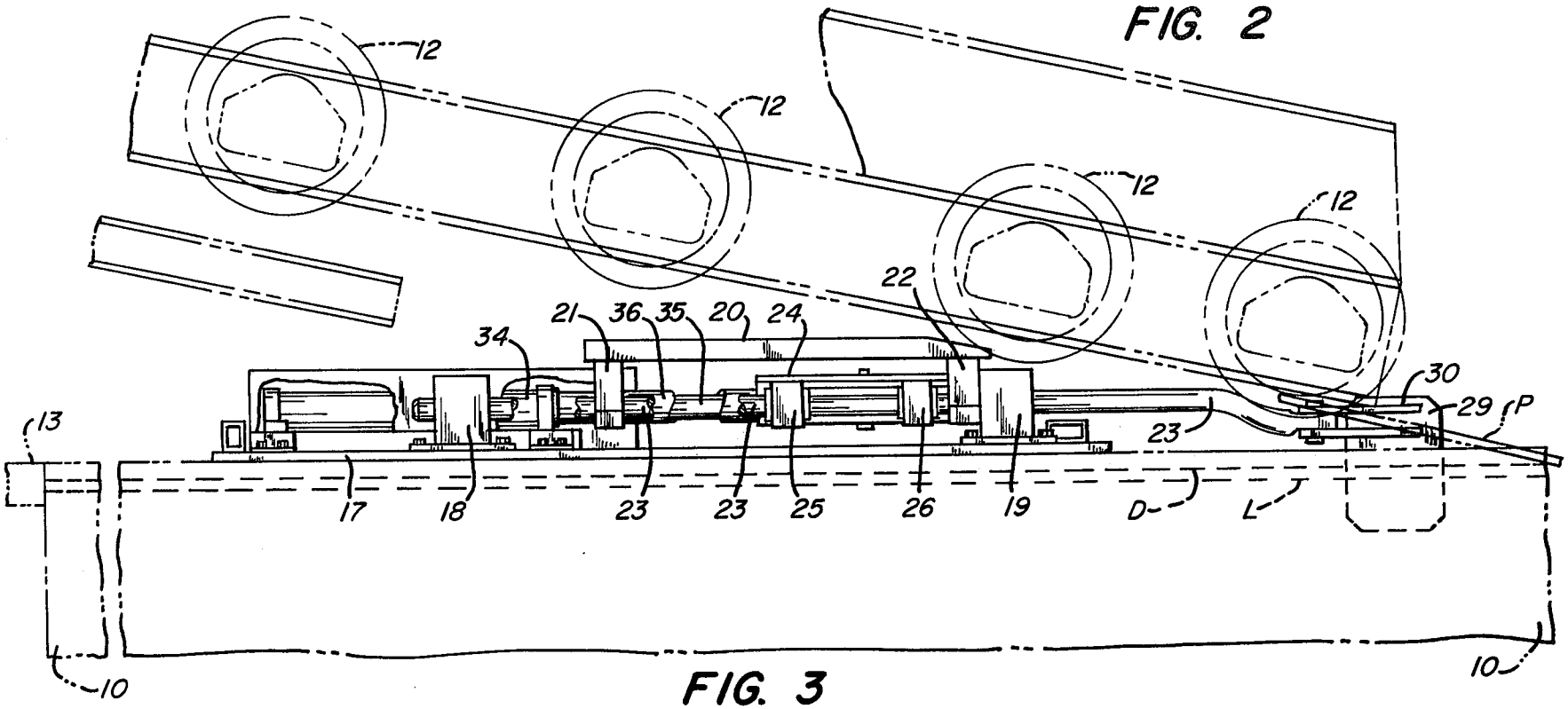
FIG. 2 is a side elevational view of our skimming device, showing also a portion of the kettle and the dragout rolls.
Figure 3:
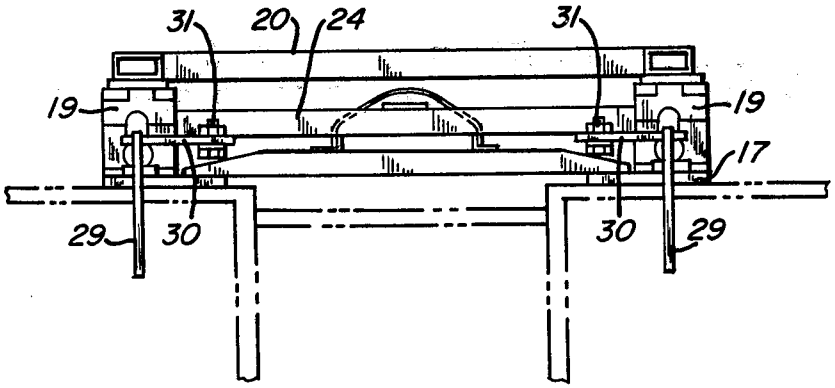
FIG. 3 is an end-elevational view of our skimming device.

FIGS. 1 and 2 show the outline of a kettle 10 and a series of magnetic dragout rolls 12 of a known form of galvanizing apparatus. The kettle contains a bath of molten zinc to approximately a level indicated at L in FIG. 2, and it has an overflow spout 13 at one edge. A layer D of dross floats on the surface of the zinc. The kettle contains mechanism (not shown) for lifting pipes P from the bath to a position where they contact the lowermost dragout roll 12, which starts the pipe on an upwardly inclined path from the bath. Reference can be made to the aforementioned McConnell et al patent for a showing of suitable lifting mechanism within the kettle. The apparatus shown is only illustrative on an apparatus with which our skimming device can be used.

Our skimming device comprises a rectangular frame 17 which rests on the upper edge of the kettle 10 and has respective pairs of spaced-apart outer and inner pillow blocks 18 and 19 upstanding from its opposite side members. A three-sided secondary carriage 20, which includes outer and inner depending lugs 21 and 22 at opposite sides and shafts 23 carried by the lugs, is supported on the frame for movement therealong. The shafts 23 are slidably received in the pillow blocks 18 and 19. A three-sided primary carriage 24, which includes spaced-apart laterally projecting outer and inner sleeve ball bushings 25 and 26, is supported on the secondary carriage 20 for movement therealong. The bushings 25 and 26 are slidably received on shafts 23 of the secondary carriage.

Respective opposed paddles 29 are pivoted to shafts 23 on vertical axes near the inner ends of the shafts. The paddles have integral operating levers 30. Respective links 31 are pivoted near their ends to the primary carriage 24 and to the operating levers 30. The paddles are movable between a first position in which their faces lie substantially parallel with the direction of carriage movement and a second position in which they extend transversely of the direction of movement.

A double-acting fluid pressure cylinder 34 or equivalent motive means is mounted on frame 17 near its outer end. Opposite ends of the cylinder are connected to a source of fluid under pressure through a conventional four-way valve (not shown), which may be motor driven for automatic operation. The cylinder contains a reciprocable piston and piston rod 35 which is connected to the primary carriage 24. Preferably th piston rod is encased in a protective boot 36.

In operation, the parts of the skimming device initially are in the position shown in FIGS. 1 and 2 in which the piston rod 35 is fully extended, and the faces of paddles 29 lie substantially parallel with the direction of movement. The paddles are approximately in line with the location at which a pipe P emerges from the bath and lie below opposite sides of the dragout rolls 12. The pivotal axis of the paddles lies approximately under the lowermost dragout roll 12.

In sequence, fluid is admitted to opposite ends of cylinder 34 to reciprocate the carriages 20 and 24 and paddles 29 through skimming and return strokes. During a skimming stoke, as the piston rod is retracted, it first moves the primary carriage 24 to the left with respect to the secondary carriage 20, thus pivoting the paddles from their parallel positions to their transverse positions. When the primary carriage 24 abuts the outer lugs 21 of the secondary carriage 20, the secondary carriage commences to move to the left with the primary carriage. The primary carriage alone moves through approximately half or a little more of the piston stroke, and the carriages move together through the remainder. In one example, the piston has a 22-inch stroke, and the primary carriage moves by itself through the first 12 inches. As the paddles pivot, they drag dross D away from the emerging pipe P. As the paddles reach their transverse portions and continue to move toward the edge of the kettle, they drag the dross toward the overflow spout 13, from which it discharges.

During a return stroke, as the piston rod 35 is extended, it first moves the primary carriage 24 with respect to the secondary carriage 20 to return the paddles 29 to their parallel positions. When the primary carriage abuts the inner lugs 22 of the secondary carriage 20, the secondary carriage commences to move to the right to bring the parts back to their original positions. The paddles lie in their parallel positions during approximately the latter half of the return stroke and hence do not push dross back to the region at which the pipe emerges from the bath.

From the foregoing description it is seen that our invention affords a simple effective device for skimming floating material from a bath, such as dross from a zinc galvanizing bath. The device drags material from the bath surface during its skimming strokes, but avoids pushing the material back during its return strokes. The device overcomes the need for performing the skimming operation manually in the example of a pipe galvanizing operation.

We claim:

1. A skimming device comprising a frame, a secondary carriage mounted on said frame for linear movement therealong, a primary carriage mounted on said secondary carriage for linear movement therealong, at least one paddle pivoted to said secondary carriage, a linkage connecting said primary carriage and said paddle, and motive means on said frame connected with said primary carriage for sequentially moving said primary carriage with respect to said secondary carriage to pivot said paddle from a position in which its faces are substantially parallel with the direction of movement to a position transverse of the direction of movement, moving both said carriages and said paddle with respect to said frame in a skimming stroke, moving said primary carriage with respect to said secondary carriage to pivot said paddle back to its parallel position, and moving both carriages with respect to said frame to return the carriages and paddle to their original position.

2. A device as defined in claim 1 in which said frame includes upstanding pillow blocks, said secondary carriage has shafts slidably received in said pillow blocks, and said primary carriage has bushings slidably receiving said shafts.

3. A device as defined in claim 2 in which said primary carriage has means abutting said secondary carriage at the end of the first portion of each stroke for moving the carriages together with respect to said frame during the remainder of each stroke.

4. In an apparatus which includes a vessel adapted to contain liquid, the combination with said vessel of a device for skimming floating material from the surface of liquid contained therein, said device being constructed as defined in claim 1, the frame of said device being supported on said vessel.

5. A combination as defined in claim 4 in which said apparatus is a pipe galvanizing apparatus.

6. A combination as defined in claim 5 in which said apparatus includes dragout rolls above said vessel, and said device includes two paddles beneath opposite sides of said rolls.

7. A skimming device as defined in claim 1 in which there are two opposed paddles pivoted to said secondary carriage on opposite sides of said primary carriage and respective linkages connecting said primary carriage and said paddles.

* * * * *